US012163292B2

(12) United States Patent
Kaslik

(10) Patent No.: US 12,163,292 B2
(45) Date of Patent: Dec. 10, 2024

(54) DEVICE FOR NON-DESTRUCTIVE TRANSFORMING OF PAPER

(71) Applicant: James A Kaslik, Tempe, AZ (US)

(72) Inventor: James A Kaslik, Tempe, AZ (US)

( * ) Notice: Subject to any disclaimer, the term of this patent is extended or adjusted under 35 U.S.C. 154(b) by 205 days.

(21) Appl. No.: 17/888,116

(22) Filed: Aug. 15, 2022

(65) Prior Publication Data

US 2024/0052575 A1 Feb. 15, 2024

(51) Int. Cl.
*D21H 23/54* (2006.01)
*D21H 25/00* (2006.01)
*A47K 10/32* (2006.01)

(52) U.S. Cl.
CPC ..... *D21H 23/54* (2013.01); *D21H 25/005* (2013.01); *A47K 2010/3273* (2013.01)

(58) Field of Classification Search
CPC ..... D21H 23/54; D21H 25/005
See application file for complete search history.

(56) References Cited

U.S. PATENT DOCUMENTS 898,720 A * 9/1908 Campbell ..... B41K 1/54 118/268
940,598 A * 11/1909 Homire ..... A01M 1/2044 222/420
958,149 A * 5/1910 Metzner ..... B41K 1/54 15/257.074
1,060,518 A * 4/1913 Ward ..... B05C 1/06 118/201
1,099,979 A * 6/1914 Holt ..... B43M 11/04 118/268
11,305,930 B2 * 4/2022 Balestri ..... B65D 25/08
2003/0202838 A1 * 10/2003 Sun ..... A45D 34/042 401/196
2016/0265788 A1 * 9/2016 McConnell ..... A47K 10/421
2017/0015482 A1 * 1/2017 Lewis ..... A47K 10/32

* cited by examiner

*Primary Examiner* — Anthony Calandra
(74) *Attorney, Agent, or Firm* — Lambert Shortell & Connaughton; David J. Connaughton, Jr.; Justin P. Tinger

(57) ABSTRACT

The device assists the customer in cleaning residue from their skin and body hair after they use a toilet for elimination, after they receive a cut or abrasion, or from other source. With the device, the person physically transforms toilet paper and other tissue-like paper in real time in a non-destructive manner to have greater texture, density, and wetness, all three of which together facilitate cleaning better than dry paper or than wet paper without such increased density and texture. Being pocket sized and intended for repeated use, the device can be easily carried by or on the person and used in any bathroom or location anywhere without modification to the plumbing facilities, without risk of running out of a supply of pre-moistened wipes, and without damaging the environment or sewage and septic systems.

9 Claims, 4 Drawing Sheets

DEVICE FOR NON-DESTRUCTIVE TRANSFORMING OF PAPER

BACKGROUND OF THE INVENTION

One constant of human existence is the need for bathroom facilities with toilet fixtures through which humans undertake bodily functions including defecation, urination, and menstruation. Upon completing that function, modern hygiene standards require cleaning oneself to keep one's skin and body hair clean and hygienic, keep one's undergarments and clothing clean and hygienic, and not spread undesirable germs, bacteria, and odors.

Likewise, there may be a need to clean the site of an abrasion to the skin, such as to remove debris, blood, and other residue, particularly where no sanitary facilities are available. The discussion herein of "residue" is meant to include this manner of material on the skin, or other substances, in addition to the products of elimination.

To clean oneself, people have attempted a variety of methods, including wiping residue with toilet paper, wetting toilet paper before wiping, directing water at residue, and wiping residue with disposable pre-moistened wipes made of a non-woven fabric. Such attempted solutions have not sufficiently addressed the needs of the industry, whether by being too flimsy to remove all residue, by smearing the residue they intend to remove, by requiring modification to plumbing or fixtures, by tearing or destructing the toilet paper in the process of wetting it, by containing single-use plastics such as polyester and polypropylene and releasing micro plastics into the environment, by being a source of septic system and sewer clogs and thus directly causing expensive repair bills, contributing to the degradation of the environment, or by other problem.

Thus, there is still a need in the art for devices that enable hygiene that effectively cleans residue from one's body and body hairs, thoroughly cleans residue without smearing it, can be used in any bathroom—public or private—at any time, do not require modifying plumbing, do not destruct the cleaning implement—toilet paper—prior to use, do not require repeated repurchase, and are not harmful to septic and sewage systems or the environment.

SUMMARY OF THE INVENTION

The device pertains to transforming toilet tissue paper in real time. More specifically, the device pertains to transforming paper's texture, density, and wetness in real time to improve its effectiveness at cleaning residue off human skin and body hair after elimination, after a cut or abrasion, or from other source of residue.

The present device enables a person to clean any residue left on their body after using a toilet for any elimination purpose, after receiving a cut or abrasion, or from other source, by simultaneously transforming in real time the texture, density, and moisture content of the paper a person uses to wipe away the residue. The device is pocket sized so that it can be carried with the person wherever they go. The device exists and performs independent of any other bathroom fixture, including the toilet, toilet tank, plumbing, or paper dispenser.

To effect the transformation of the paper by the device in real time on an as-needed basis requires liquid, a mold, and pressure. The liquid, which may be tap water, is retained in a container until released by pressure from a human hand pressing dry paper onto the mold formed by a flexible coarse mesh in proximity to the stored liquid.

With that pressure from the hand and the resistance of the flexible coarse mesh, the liquid is absorbed by the paper through the holes of the flexible coarse mesh, with the volume of wetted paper forced into the mold under pressure creating a multiplicity of dense, substantial, differentiated, and distinct nubs on the paper. The pressure of paper onto the mold formed by the flexible coarse mesh, which may vary based on the quality of the paper being transformed and other factors, must be sufficient to deform the paper such that it may compress into and fill the mold to achieve an increased density of the paper in the shape of the mold and substantially holds its form when wiped on skin or a surface.

The quality of the transformation enabled by the device is affected by the size of the flexible coarse mesh mold being sufficient to form nubs substantial in size and quantity as well as density, and may be aided by the coarse mesh being attached to a container that restricts escaping liquid so as to direct released liquid primarily through the coarse mesh. The quality of the transformation is also dependent on the device not presenting gaps or folds that will pinch the transformed paper as it's withdrawn and thus tear or destruct or deconstruct the densified texture that was imparted onto the paper.

The transformation enabled by the device is conducted in real time, when and where the need arises and according to the perceived need. The thusly transformed paper, wiped on the skin, body hairs, and surfaces, provides superior cleaning by virtue of its newly acquired texture, density, and wetness, and is more effective at the task than paper without these three properties. The transformed paper decomposes in water in a manner and at a rate substantially the same as used, untransformed paper, such that there is no differentiated detriment to sewage and septic systems.

Variations that increase the value of the device provide a flexible container encasing the coarse mesh, which itself may be encased in a rigid or semi-rigid case. Other variations allow for the device to include flow-limiting components to control the flow of the liquid from where it's stored in the container through the mesh and into the paper to preclude soggy paper that can't hold persistent texture, such flow-limiting components which may include absorbant materials such as a sponge or cloth, and a flexible mesh with flow-limiting holes coincident with those of the flexible coarse mesh mold but smaller, either as a separate component or as integrated with the flexible coarse mesh mold. Other variations provide for creating cleaning grooves in the paper, in addition to textural nubs, by including raised extrusions on the mesh.

DETAILED DESCRIPTION OF THE INVENTION

Figure 1:
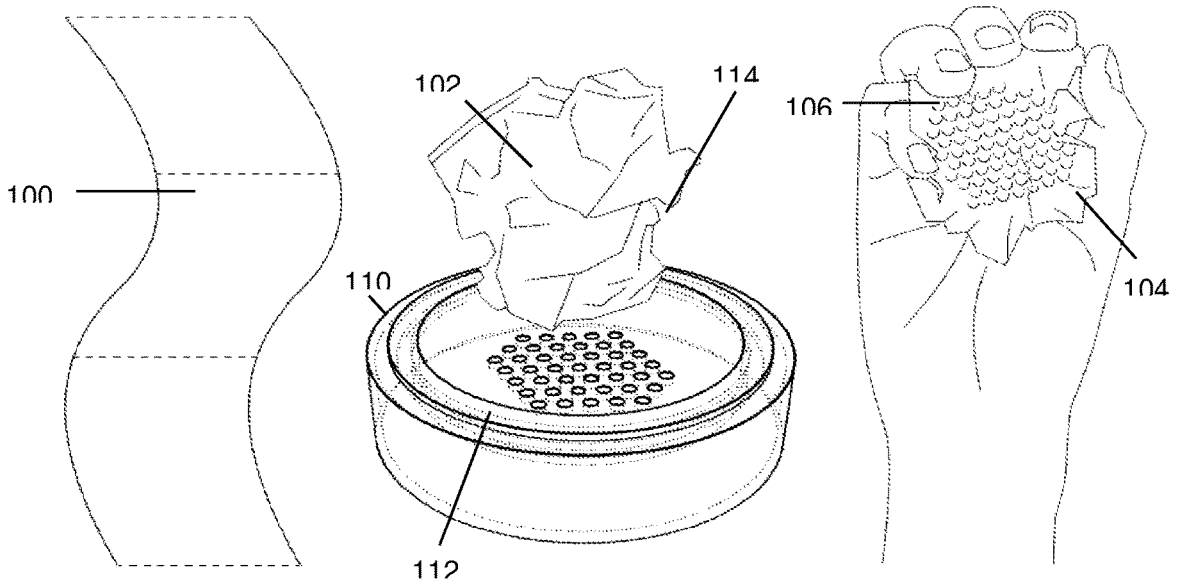
FIG. 1 schematically depicts the pocket-sized, non-destructive, paper-transforming device according to one embodiment of the present disclosure.

It should be understood that the description and drawings herein are merely illustrative and that various modifications and changes can be made in the structures disclosed without departing from the scope of the appended claims. It will also be appreciated that the various identified components of the exemplary non-destructive paper-transforming device disclosed herein are merely terms of art that may vary from one manufacturer to another and should not be deemed to limit the present disclosure.

The present device facilitates a person cleaning any residue left on their body after using a toilet for any elimination purpose, after receiving a cut or abrasion, or from another source, may be reusable indefinitely, and may be pocket sized so that it can be carried with the person wherever they go. The device's pocket size additionally enables it to be individualized, such that each customer may have a device configured to their needs and tastes, and touched only by them to limit spread of germs. The customer is generally provided with the device which they may use with any or every visit to a bathroom or other location, adds their own water from a faucet, bottle, or other source intermittently as needed, or other cleansing or therapeutic liquid, and uses it with the supply of toilet paper 100 or other tissue-like paper existing at that location or which they separately provide, which the device transforms in real time, based on the present needs of the customer, into a superior configuration for removing the residue. The transformed paper 104 has greater texture, density, and wetness than the paper in its normal state, including greater densified texture than that of manufactured "textured" toilet paper, and greater texture and density than manufactured pre-moistened bathroom wipes and toilet paper that is merely wetted, with the real-time transformations working in concert to create a sturdier wiping product and effect improved hygiene. The present embodiment of the device protects the transformed paper from being destructed or torn through pinching or snagging of the wet paper by ill-placed folds or gaps in the device.

The device is a waterproof container 110, 154 that may be rigid, semi-rigid, or flexible, topped by a flexible coarse mesh mold 111, 112. The container has an access opening 150 in the top and may have a lid. The customer will intermittently add liquid, which may be water, through the opening 150 until the container is as full as they prefer and then becomes progressively less full with each of what may be multiple uses of the device until the customer again adds liquid. They may close the optional lid when the device is not in use or is being transported to prevent evaporation or spillage.

After the person uses the toilet for the elimination activity, they may crumple typically three-to-five sheets of paper 100 into a loose ball 102, and press it with their fingers through the opening 150 of the device against the flexible coarse mesh mold 111, 112 and into the liquid. With that brief press of approximately one-half second in length on average, the paper, as it's being pressed into the holes, will absorb a small amount of liquid through capillary action, and the pressure from pushing the paper against the flexible coarse mesh mold with sufficient applied force to deform the mesh to dip into the liquid will immediately and simultaneously impart both substantial distinct texture 106 (via the mold) and density (via the pressure) onto the now-wetted paper 104, and from the continuous geometry of the flexible coarse mesh mold within the container, lacking and not encountering any closing gaps or tight folds, the paper will be whole and not be pinched, torn, or pulled apart as the paper is withdrawn and the flexible coarse mesh mold returns automatically to its relaxed state. The texture, density, and wetness simultaneously enabled by the device make the transformed paper 104, 106 more effective at wiping away the residual residue than paper without such texture, density, and wetness, and specifically more effective and sturdier than paper which is dry or merely wetted. The areas that may be wiped include the anus, buttocks, and perineum, including both skin and hair, the upper thighs, the vulva and pubic hair, and any other part of the body that may benefit from cleaning, which is enabled by the densified texture imparted to the paper. Additional areas that may benefit from cleaning with the transformed paper 104, 106 include fixtures such as the toilet seat, toilet tank flushing handle (or lever or button or knob), door knob, and faucet. After being used to wipe away residue, the transformed paper 104, 106 is then disposed of in the typical fashion, where it will decompose in much the same fashion as untransformed paper.

This configuration offers significant improvement by allowing transformation and use of a wide variety of papers. The term "paper" refers to any of the class of paper products defined as "tissue" by weight, which as an industry term are those of low weight, generally <40 g/m$^2$ (grams per square meter). This includes toilet paper 100, facial tissue, paper towels, and more. There can be a big variation in the quality of paper provided at a toilet location, from 3-ply plush in a home to 1-ply basic in a commercial building or portable potty. This device may transform all such paper in real time with increased texture, density, and wetness to enable its use for effective cleaning of the person directly, plus the additional surfaces of the facility into which the person may come in contact.

Figure 2:
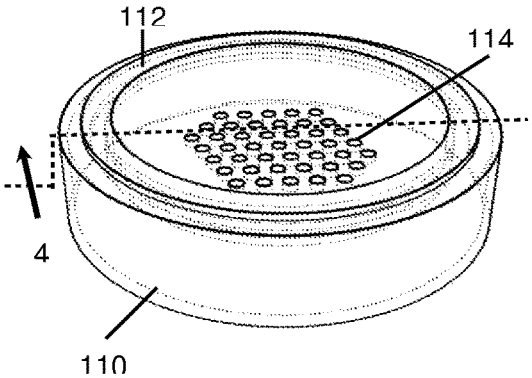
FIG. 2 is a front perspective view of the device of FIG. 1.
Figure 3:
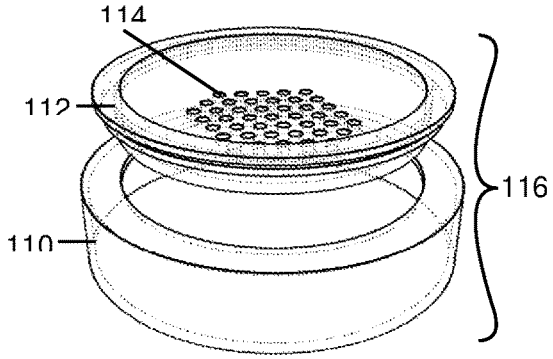
FIG. 3 is a front exploded view of the device of FIG. 1.

This pocket-sized configuration offers a significant improvement because the device can be carried discretely to wherever a person might use a bathroom, whether at home or away, private or public, in a facility with full plumbing or a portable potty with no water. As best depicted in FIG. 2, the device may be a circular prism which may have rounded edges that has a preferred diameter of 7.5 cm and depth of 2.0 cm to balance portability with liquid storage, though the shape and dimensions may vary substantially and still allow the device to be both discrete and portable, and to fit in the pockets, fanny packs, and purses which a human being might typically wear or carry, all of which sizes are herein encompassed by the term "pocket-sized". It may be effective at 5 cm×5 cm×1 cm or other sizes smaller than the preferred size, and in larger sizes, and in a substantial variety of geometric shapes, including rectangular prism, circular prism (cylinder) 110, ovoid, and elliptical, with other shapes contemplated. Sizes close to the preferred size are all equally effective, with variations enhancing the portability or liquid storage capacity of the device as preferred by the manufacturer.

Figure 11:
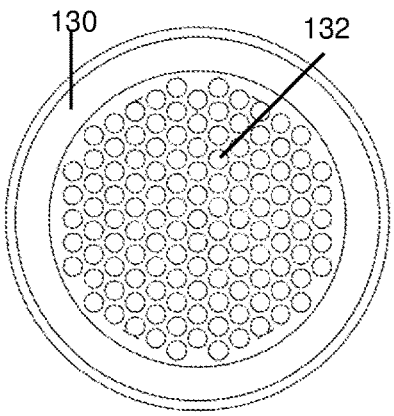
FIG. 11 is a top view of the mesh of FIG. 1 with a mold with round holes.
Figure 12:
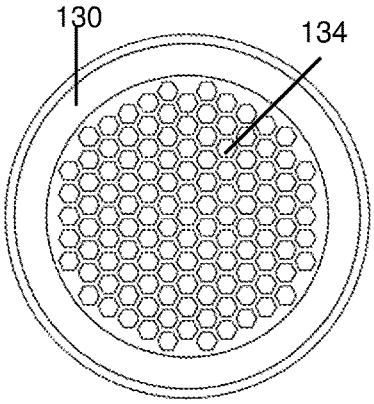
FIG. 12 is a top view of the mesh of FIG. 1 with a mold with hexagonal holes.
Figure 13:
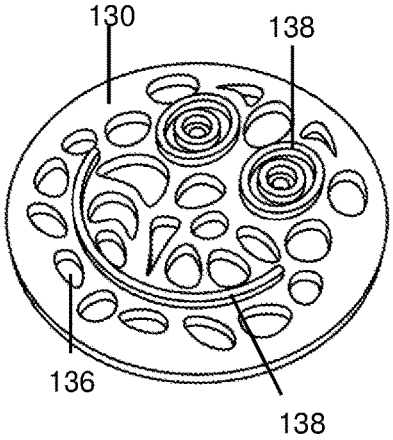
FIG. 13 is a top view of a mesh with amorphous holes and an extruded design.
Figure 14:
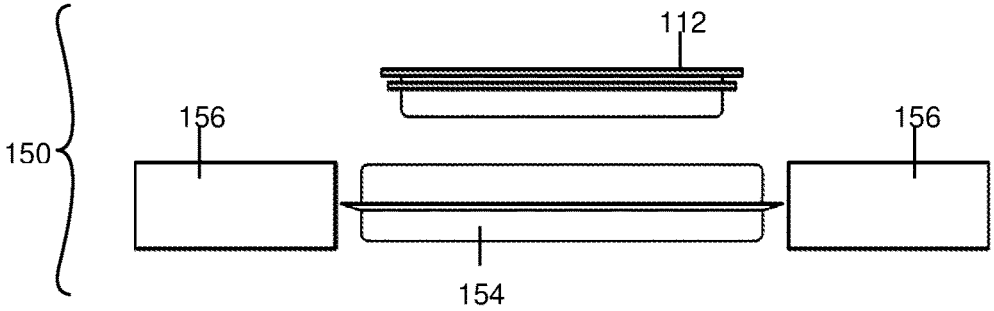
FIG. 14 is a front exploded view of non-destructive paper-transforming device according to another embodiment of the present disclosure.

The device's configuration with a flexible coarse mesh mold 111, 112 offers a significant improvement because the flexible coarse mesh mold enables the real time formation of dense texture 106 in the transformed paper 104, and also protects the transformed paper from being torn or deconstructed as it's removed from the device. By engaging the container from the top side, rather than being entirely internal to the container, the smooth-sided flexible coarse mesh mold avoids gaps between itself and the container that would trap and tear paper and render it unusable for the purpose. Its ability to deform where pressed with more force allows the user to better control the absorption of liquid into the paper, whereas a rigid mesh, such as a metal plate, would engage the liquid equally across the entire field of holes with more liquid passing through holes uncovered by paper than those in contact with paper, which is the opposite of the desired transformation. Thus the term "flexible" defines a material that can bend easily without breaking, that doesn't easily develop fautigue (and fautigue-caused cracks), and that has material memory and the ability to substantially return to its relaxed form when no force is applied. The term "mesh" defines a field of material, such as plastic, silicone rubber, or urethane, but including many other materials, and which may be of non-uniform thickness and may include a plurality of high areas and low areas, with a field of thru-holes of any geometric shape imparted by typical means, such as through the process of forming the sheet by injection molding or 3D printing, for example; or a layering of a plurality of such materials; with other such materials also contemplated. A mesh has thru-holes (or "holes") 114, such holes including the volume of any contiguous concave or elevated area on the top of the mesh as part of the hole, that allow passage of liquid from one end through to the other and a material (or webbing) which forms and separates the holes, each with their own sizes. The holes may have a top area nearest to the mass of the paper wider or narrower than the bottom area nearest to the sponge, such as to mold a tapered or stepped texture, or may be substantially uniform throughout the depth of the hole, such as to mold a prismatic texture, and may have chamfered, rounded, notched, or other edges on each or either end. Such holes may be organized into a grid pattern or any other pattern—including patterns that form a specific design—and may be circular 132, hexagonal 134, or any other shape 136, as depicted in FIGS. 11, 12, and 13 respectively as preferred by the manufacturer. The "flexible coarse mesh mold" may thus be defined as a component of flexible material and thru-holes that inserts into or onto and may attach to the container 110 with a generally smooth and continuous exposed surface that is free of elements such as gaps or tight folds or sharp sections, including gaps between the mesh and the container, that would grasp, snag, tear, or pinch the paper 104 and impede or destruct or deconstruct the transformation imparted onto it and render it useless.

Holes in the mesh mold that are small, where no planar slice of the hole parallel to the horizontal plane has a dimension between any two points along the perimeter greater than or equal to 1.5 mm, form a "small mesh" that may prevent the insertion of a sufficient mass of paper into the mold of the mesh to form a substantial textural "nub" 106, or the shaped, densified, wetted paper that projects outward from the surface of the compressed paper 104, which density is enhanced by being forced with pressure against the flexible coarse mesh mold 111, 112, and which significantly enables cleaning of residue. A mesh mold that is thin from top to bottom (<1.0 mm on average, whether in its relaxed state or when the force to deform it is applied) forms a "thin mesh" without deep, substantial nubs. Holes in the mesh that are distant from adjacent holes, such that there may be less than 5% hole versus webbing by area, for example a solitary 2 mm×2 mm hole in a 1 cm×1 cm area, form a "sparse mesh" that may have insufficient concentration of nubs to comprehensively clean residue. As this relates to common items, a typical window screen or wire kitchen sieve is a mesh that is too small and too thin to mold substantial nubs and by extension a substantial texture such as enabled by the present device. A typical metal kitchen colander may have larger holes, but is generally too thin and with holes that may be too sparse, and may also not create substantial texture nor enough of it. Thus, a mesh that is too fine, or a "fine mesh"—whether from small hole size or lack of depth or low concentration of holes, i.e., a small mesh or a thin mesh or a sparse mesh—may create an insufficient transformation of the paper for the most effective cleaning; the paper may be wet and may even be dense, but without sufficient texture provided by substantial, densified, and differentiated nubs 106 it may smear residue on the skin rather than remove it.

Therefore, a "coarse mesh" 111, 112 would define a mesh that is not a fine mesh, and that, whether rigid or flexible, must be able to be repeatedly pressed a multitude of times with even or uneven pressure from the paper without tearing, breaking or permanently deforming the mesh. The coarse mesh 111, 112 being in proximity to the liquid offers a significant improvement because the combination of liquid, the coarse mesh mold 111, 112, and the applied force of pressing causes the paper to fill the holes 114 in the coarse mesh as though it were a mold, with the walls of each hole forming the sides of the mold and the thickness of the mold limiting the passage of paper fibers beyond the boundaries of the mold to create the end of the nub, and enabling delivery of variable volumes of liquid with variable applied force, shaping the wetted paper in real time into a compressed and densified three-dimensional structure and thusly transforming dry sheets of paper 100, 102 into a textured, densified, wetted body 104 with a substantially nub-covered 106 surface whose denseness and sturdiness is more able to hold its transformed shape, and thus less prone to flattening or tearing when wiped across the skin and body hairs, than paper which is dry or merely wetted or soggy. The size and spacing of the nubs 106 influences the effectiveness of the transformed paper 104, as it is the unoccupied spaces between nubs that primarily collect the residue and minimize smearing as residue is being wiped from the surfaces. In the preferred configuration, the nubs 106 from the mold formed by the flexible coarse mesh 111, 112 will be between 3 mm and 5 mm in width or diameter, generally be spaced between 1 mm and 2 mm on average from adjacent nubs for differentiation without excess voided area that may smear more than clean, and project at least 2 mm from the surface of the paper.

Holes 114 in the field of the mesh 111, 112 need not be uniform in width or depth. While one fine-mesh hole (whether from small size or depth or both) in a field of coarse holes coincident with the opening in the container may not appreciable reduce the cleaning effectiveness of the transformed paper, and one coarse hole in a field of fine-mesh holes may not appreciably increase the cleaning effectiveness, a mesh with a plurality of coarse holes where any three cm diameter circle on the field overlaps one or more coarse holes such that the aggregated area of all the overlapped holes, coarse and fine, measured using the volume of each such hole divided by its average depth, is five percent or greater of the area of the circle may perform substantially as a mesh comprised of all coarse openings, and is thus considered a coarse mesh. While a fine mesh results in insufficient texture, a coarse mesh 111, 112, serving as a mold for the paper 102, and in concert with other elements of the device, enables real-time transformation of the paper into a textured, densified, and wetted form 104 with a multiplicity of substantial and differentiated nubs 106 providing an abundance of raised areas and edges that are suited to the task of cleaning residue from the skin and body hairs of a human being and from the fixtures the humans may encounter in a public or private bathroom.

This configuration with the flexible coarse mesh mold 111, 112 fitting securely in the opening of the container 110, 154 defining the term "insert", facilitates that liquid being transfered directly through the mesh into the paper 102 benefitting the customer by giving them greater control over the amount of liquid transferred to the paper as needed for the task at hand. The present configuration additionally allows the flexible coarse mesh mold 111, 112 to be a self-contained solution, simplifying manufacturing, in that the flexible coarse mesh mold insert returns to it's relaxed position automatically when the pressing force is withdrawn, whereas an alternative embodiment with a mesh in a planar configuration interior to the container would fall to the bottom of the container unless supported and returned to its original position by an additional component and mechanism.

In the preferred use, the container 110 encasing the liquid and mesh may be waterproof and rigid or semi-rigid to provide stability when pressing onto the mesh. It may be made of any material compatible with the liquid or liquids added to the container, including, for example, silicone, urethane, high density polyethylene (HDPE) and other plastics, glass, fiberglass, stainless steel, copper, ceramic, carbon fiber reinforced polymer, and many others. The rigidity means the container 110 will not substantially deform when paper 102 is pressed against the mesh 111, 112 and into the liquid.

Figure 15:
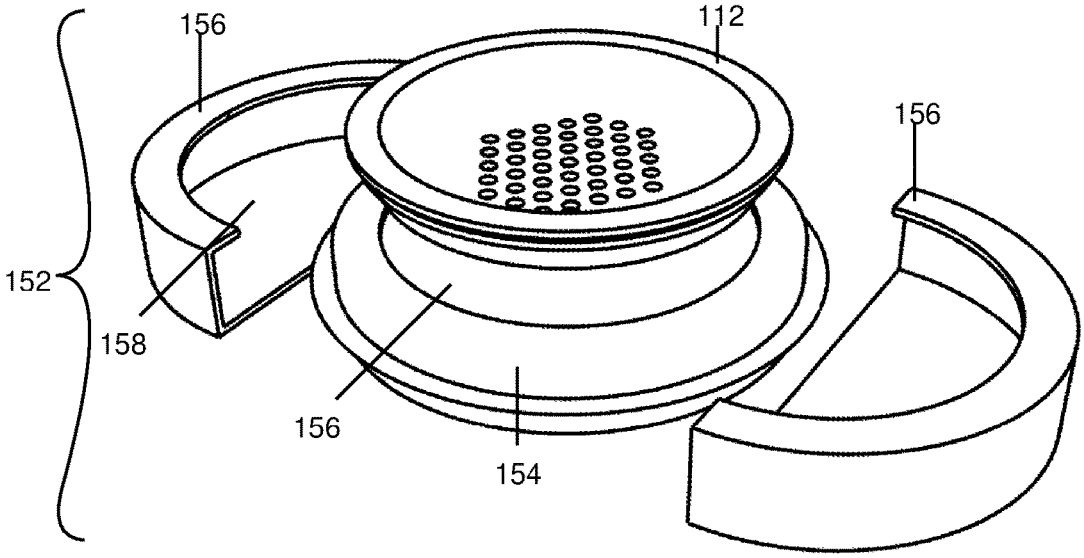
FIG. 15 is a front perspective view of the embodiment of FIG. 14.

In an alternate configuration, the container encasing the liquid and mesh may be waterproof and flexible 154. It may be made of any flexible material that is compatible with the liquids added to the sponge, including, for example, soft silicones, urethanes, and plastics (low-density polyethylene, pvc, etc), rubber, BoPET (Biaxially-oriented polyethylene terephthalate, aka Mylar), neoprene, and others. Rigidity to stabilize the device and enable it to not substantially deform when paper 102 is pressed against the contained mesh 138 may be achieved by encasing the container in a rigid or semi-rigid case 156, as best depicted in FIG. 15, which has a compatible top opening 158 and which need not be waterproof and may be in multiple parts. The flexible container 154 may deform sufficiently to be inserted into such a case through just the top opening, if said case is a single piece. Such case could be made of metal, bamboo, wood, cork, ceramic, glass, silicone, plastic, stiffened leather, with other materials also contemplated.

The opening 150 of the container 110, 154 should be of sufficient size to fit fingers holding crumpled paper 102, 5 cm to 7 cm in diameter being preferred, with the advantage to the customer of being a single location where liquid is added and paper is pressed without the customer having to manipulate or disassemble the device. The preferred shape is round, but with no inherent benefit over other shapes that allow insertion and withdrawal of the paper.

In the preferred embodiment, the coarse mesh 130 may be provided by an insert 112 that snaps or fits securely into the opening 150 of the container 110, 154. The insert 112 may be a single unit of a flexible material (such as silicone, urethane, a thermoplastic, or a styrene-based copolymer, but other similarly durable and flexible material is also contemplated), and have a lip 133 that may extend partly or entirely around the container to secure its position on the container and may have a groove 135 for a stronger attachment, transitions continuously to form a field for the holes in the coarse mesh 130 along the bottom of the insert, without gaps or folds that could snag or pinch the paper.

In an alternative configuration, the coarse mesh 130 may include extrusions 138 in addition to holes. The extrusions 138 are distinct raised surfaces on the top side of the field of holes in the coarse mesh 130. The extrusions 138, which may be in the shape of straight lines, curved lines, or form a design as if drawn by lines, create grooves or depressions in the transformed paper, where such grooves aid in cleaning by being a repository for the cleaned residue. As such, they complement the textural nubs 106 formed by the holes. The extrusions 138 will in the preferred embodiment be 1 mm wide and extend 1 mm above the surface of the mesh 130, though they may be other widths and other heights. In the preferred embodiment, the distance from the bottom of the mesh 130 to the top of the extrusions 138 will be 3 mm or less, though may be more.

Figure 4:
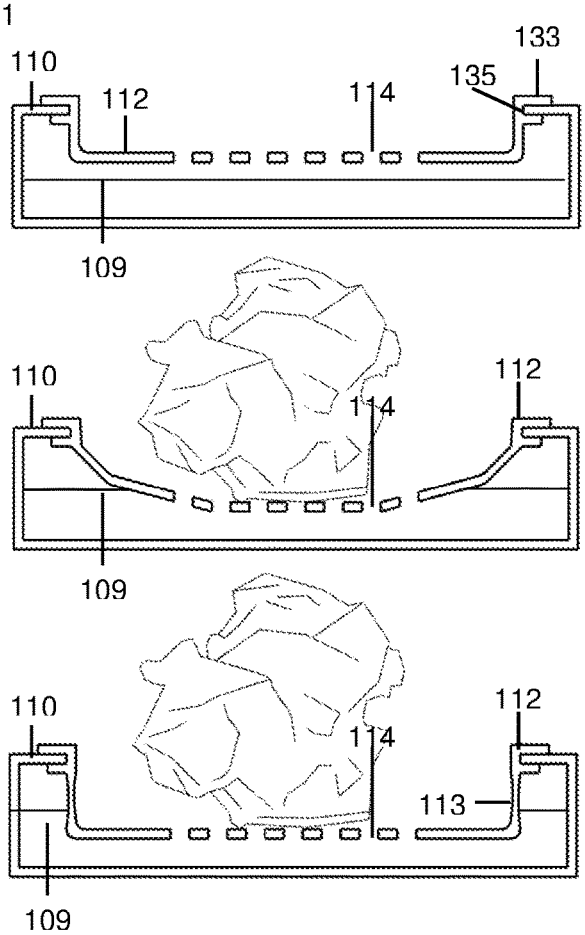
FIG. 4 is a front cut-away view of the inner components of the device of FIG. 1 in its relaxed state with water level depicted, with a flexible coarse mesh mold when pressed by a human hand with paper, and with an elastic coarse mesh mold when pressed by a human hand with paper.

In an alternative configuration, as depicted in FIG. 4, the side walls of the flexible coarse mesh mold insert 113 may be of an elastic material (such as silicone or a styrene-based copolymer, with other similarly elastic materials also contemplated) connected to the upper and lower parts of the insert via overmolding or insert molding, for example, or the entire flexible coarse mesh mold 112 may be of an elastic material, to allow the mesh to be pressed into the liquid by stretching and relaxing. This configuration may also be known as an elastic coarse mesh mold.

Figure 9:
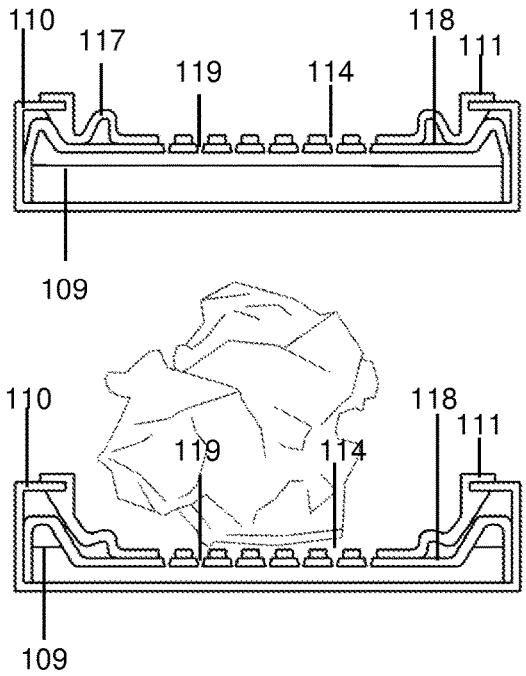
FIG. 9 is a front cut-away view of the inner components of the device of FIG. 7 in its relaxed state and when the undulating flexible coarse mesh mold and flexible flow-limiting mesh component are pressed by a human hand with paper.
Figure 10:
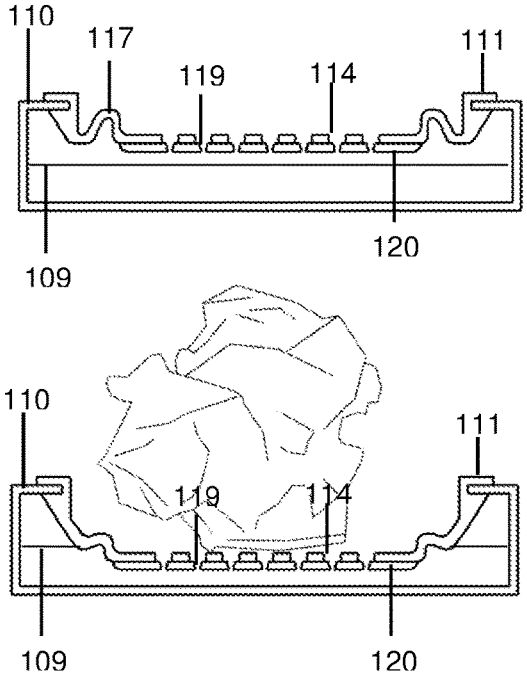
FIG. 10 is a front cut-away view of the inner components of the device of FIG. 7 with an integrated flow-limiting mesh in its relaxed state and when the undulating flexible coarse mesh mold and integrated flow-limiting mesh are pressed by a human hand with paper.

In an alternative configuration, as depicted in FIGS. 7-10, the lip or the side walls of the flexible coarse mesh mold 111, 112 may transition to the field of holes via one or more concentric waves, undulations, or ripples 117 that may continuously widen from the closed side to the open side so as not to pinch the transformed paper 104. Such waves 117 of material allow the mesh to extend into the liquid when pressed as depicted in FIGS. 9 and 10 and return to its relaxed position automatically when other forces are withdrawn without creating any section of the mesh that would fold onto itself to grasp or pinch the transformed paper 104 whereby, in the process of pinching the paper, destruct or deconstruct the transformations by tearing it or pulling apart its layers.

Figure 5:
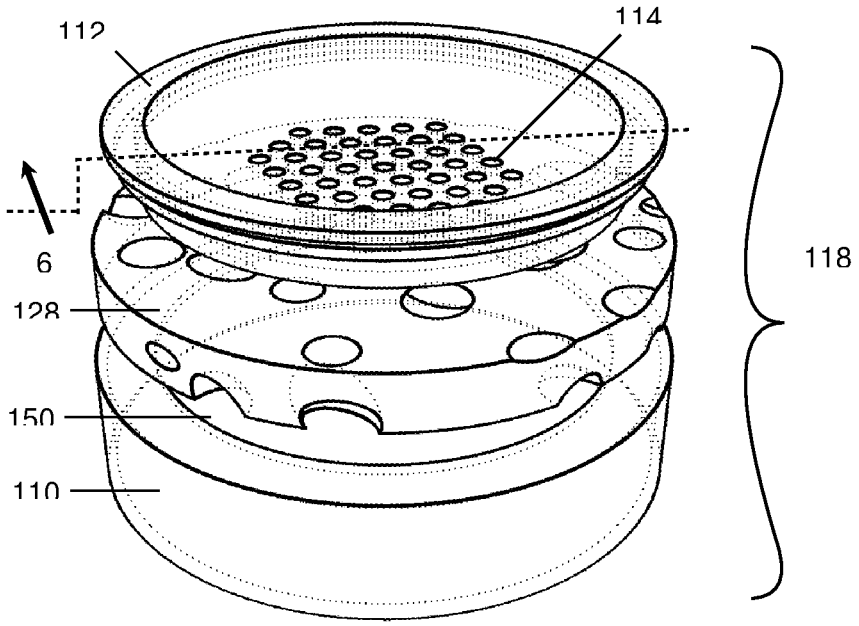
FIG. 5 is a front exploded view of the device of FIG. 1 with the inclusion of a sponge as a flow-limiting component.
Figure 6:
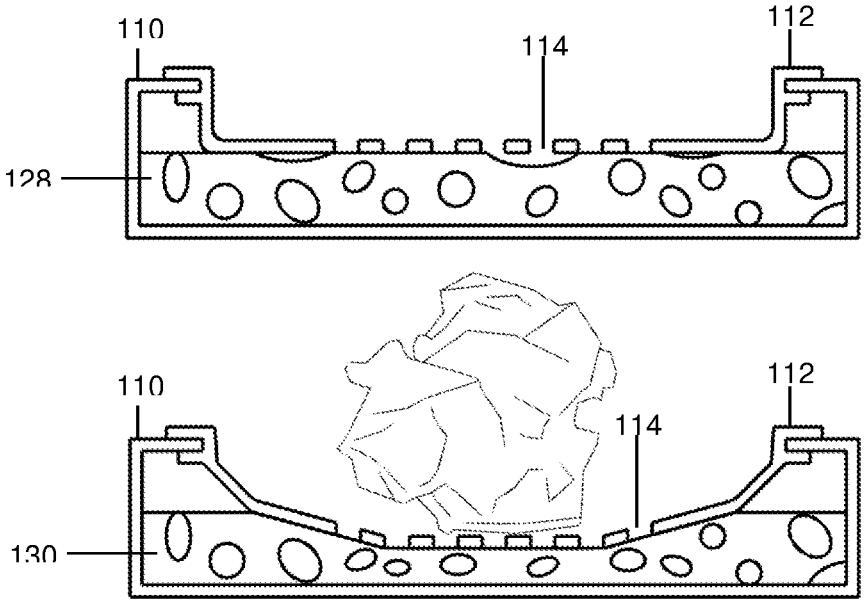
FIG. 6 is a front cut-away view of the inner components of the device of FIG. 5 in its relaxed state and when the flexible coarse mesh mold and flow-limiting sponge are pressed by a human hand with paper.
Figure 7:
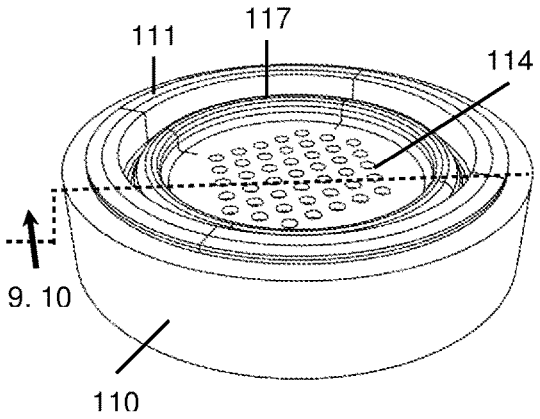
FIG. 7 is a front perspective view of the device of FIG. 1 with the inclusion of an undulating flexible coarse mesh mold and flexible flow-limiting mesh component.
Figure 8:
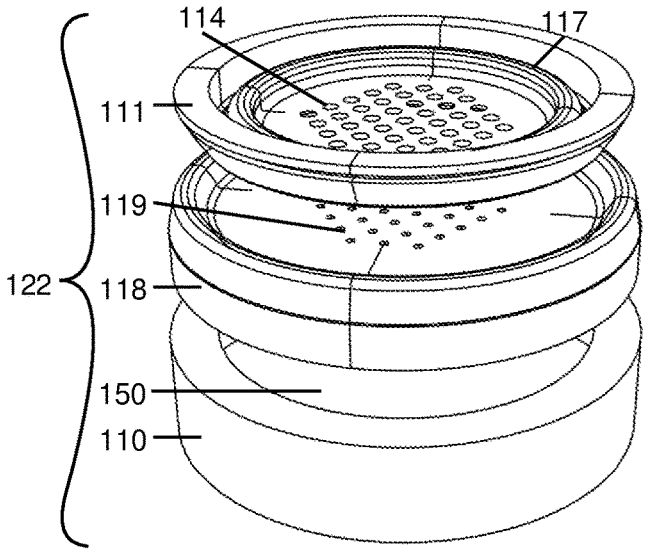
FIG. 8 is a front exploded view of the device of FIG. 7.

In an alternative configuration, as depicted in FIG. 5, the space between the mesh and the bottom of the container may contain a sponge 128 that stores the liquid and dispenses it when pressed 130. The sponge 128 may be any flexible, absorbent, porous material that may be an actual natural sponge from the ocean or may be a synthetic sponge or cloth or layered cloth or permeable material, separate or in combination, made of materials such as cellulose, bamboo, cotton, or polyester in whole or part with other such materials contemplated, with the defining characteristics of being flexible, porous, absorbent, and capable of releasing absorbed liquid when pressed. All such forms of the material are referred to for convenience by the term "sponge". For reasons of reliable performance, longevity, and environmental responsibility, the preferred embodiment of a sponge 128 is one made of plant-based cellulose fibers.

The device's configuration with a sponge 128 as the storage offers the customer an advantage because the liquid will flow into the paper 102 more gradually and the liquid content naturally disperses substantially equally throughout the material, enabling commensurately equal transfer of the liquid to paper 102 without additional dispersal mechanism. The device's configuration with a sponge 128 as both the storage and dispensing mechanism offers the customer an advantage because it limits unintended leakage of liquid from the device and obviates the need for an additional liquid storage component and thus may further enable the device to be pocket-sized and transportable.

In an alternative configuration, as depicted in FIG. 9, the space between the flexible coarse mesh mold 111, 112 and the bottom of the container 110 may contain a flow-limiting mesh 118. The flow-limiting mesh 118 may be of a flexible material, such as silicone or urethane, and may have side walls transitioning to a top surface that deform when pressed to allow the top surface to dip into the liquid and return to the relaxed state when not pressed, said top surface having a field of holes 119 that align with the holes in the flexible coarse mesh mold. While the holes 114 in the flexible coarse mesh mold 111, 112 enable the formation of textural nubs 106, the holes 119 in the flow-limiting mesh 118 serve to control and limit the flow of liquid 109 from the container 110 through the holes 119, 114 into the paper 102 to avoid saturation of the paper. This offers the consumer the advantage of controlling the movement of liquid without introducing the cleaning requirements for a sponge 128.

In an alternative configuration, as depicted in FIG. 10, a flow-limiting mesh 120 is integrated into the flexible coarse mesh mold 111, 112. The flow-limiting mesh 120 may be of the same material and created as one piece with the flexible coarse mesh mold 111, 112, or may be of a different durometer or elasticity, or different in other property, and overmolded onto or adhered to or otherwise attached to the bottom of the flexible coarse mesh mold 111, 112. This offers the consumer the advantage of controlling the movement of liquid 109 without introducing the cleaning requirements for a sponge 128 and without requiring a separate component 118 for the flow-limiting capability.

The holes 119 in the flow-limiting mesh 118, 120 of either configuration may be conical or otherwise tapered in shape or other shape and may be 1.5 mm in diameter or less on the bottom surface, and 1.0 mm in diameter or less in the preferred case, and may preferably be on their top surface greater than or equal to the size of the bottom opening to encourage free flow of liquid into the container, such as when filling it from a water source, and constrained flow out of it, such as when pressed by paper 102 pushing against the flexible coarse mesh mold 111, 112 which presses against the flow-limiting mesh 118, 120. The constrained flow of liquid 109 into the paper 102 in the preferred configuration of the flow-limiting mesh 118, 120 may be approximately 0.5 tsp (2.45 ml) per half-second press, but may be more or less depending on the manufacturer's preferences. The material of the flow-limiting layer may be any thickness, with a preferred thickness of 2 mm.

This device's configuration with any of the flow-limiting components 118, 120, 128 offers an improvement because the components afford the customer finer control over the amount of liquid 109 transferred to the paper 102 in a given time unit or with any given press of the paper 102 onto the flexible coarse mesh mold 111, 112, without which control, for example with paper 102 dipped directly into a pool of water or placed into a stream of water such as from a faucet or pressed onto a saturated sponge or other material, the paper 102 may rapidly absorb excess liquid and become saturated and soggy, where such excess liquid may render the paper unable to be transformed into the dense structure or unable to form and retain the effective texture that is enabled by the present device. Only a small amount of liquid 109 may be required for formation of texture and for effective cleaning, with 7.5 ml (approximately ½ tablespoon)±25% being sufficient and preferred for most applications, providing the feel and cleansing benefit of moisture without leaving the skin being wiped or the fingers holding the paper wet and in need of drying, though more liquid may be helpful with more dispersed, dried, or stubborn residue, while substantially less water may leave the paper undifferentiated from the paper in its original dry form 102. With this configuration, the customer is able to control, in real time and in response to the anticipated nature and location of the residue needing cleaning, the amount of liquid and pressure transforming the paper 102 by the force with which they press and the length of time they press against the flexible coarse mesh mold 111, 112, simultaneously texturizing, densifying, and wetting the paper 104.

In the preferred configuration, the insert 111, 112 may be removable and replaceable by the user for reasons of whim, aesthetic preferences, alternate mesh patterns, cleaning, or other reason.

What is claimed is:

1. A pocket-sized device for non-destructive transforming of paper in real time, comprising:

a pocket-sized waterproof container capable of holding a volume of liquid, with a top opening through which to intermittently add and access liquid; and a flexible coarse mesh mold with holes that is engaged from a top side of said pocket-sized waterproof container instead of being an integral part of the pocket-sized waterproof container, leaving no gap between the flexible coarse mesh mold and the pocket-sized waterproof container, that is able to be repeatedly pressed downward with a mass of paper, and deform and extend to dip into the liquid, and wet and mold the paper through the holes of the flexible coarse mesh mold to form substantial densified textural nubs of the paper, and return to relaxed form and position when the paper is withdrawn;

wherein, a circumference of the flexible coarse mesh mold includes a slot that matches and clicks with a flange placed on an inner side wall of the pocket-sized waterproof container, securing the flexible coarse mesh mold in place.

2. The device of claim 1, wherein the flexible coarse mesh mold further includes raised areas or extrusions on the top-facing side of the said flexible coarse mesh mold, in addition to holes, that create indentations in the transformed paper when the paper is pressed onto the flexible coarse mesh mold and extrusions and wetted.

3. The device of claim 1, wherein said flexible coarse mesh mold may be comprised of a section of an elastic material in whole or part, including as a band of material, that enables it to extend into the liquid by stretching and resume its relaxed position when not pressed.

4. The device of claim 1, wherein said flexible coarse mesh mold may be comprised of a section of material that includes at its widest point one or more flexible concentric waves, ripples, or undulating rings that enable said flexible coarse mesh mold to extend into the liquid and resume its relaxed position when not pressed without creating folds or closing of gaps that would grasp, pinch, snag or otherwise damage or deconstruct the transformed paper as the paper is withdrawn.

5. The device of claim 1, further comprising a flow-limiting sponge that in its relaxed state resides in said pocket-sized waterproof container and beneath said flexible coarse mesh mold that absorbs liquid, and releases liquid when pressed at a lesser flow rate than unconstrained liquid, to allow greater control to the wetting of the paper.

6. The device of claim 1, further comprising a flexible flow-limiting mesh that in its relaxed state resides in said pocket-sized waterproof container and beneath said flexible coarse mesh mold, with a flexible supportive base that deforms when pressed to provide resistance to the paper pressing into the liquid and returns to its relaxed position when not pressed, and with flow-limiting holes that are conical in profile with the bottom opening of equal or lesser size as the top opening, aligned with and smaller than the holes in the flexible coarse mesh mold, that allow liquid to flow through the flow-limiting holes and into the said pocket-sized waterproof container, and releases liquid, when pressed, at a lesser flow rate than unconstrained liquid to allow greater control to the wetting of the paper.

7. The device of claim 1, further comprising a flexible flow-limiting mesh that may be is integral with, attached to, or overlaid onto the under-side of said flexible coarse mesh mold so as to move in concert with the flexible coarse mesh mold, with flow-limiting holes that are conical in profile with the bottom opening of equal or lesser size as the top opening aligned with and smaller than the holes in the flexible coarse mesh mold, that allow liquid to flow through the flow-limiting holes and into said pocket-sized waterproof container, and releases liquid, when pressed, at a lesser flow rate than unconstrained liquid to allow greater control to the wetting of the paper.

8. The device of claim 1, further comprising an outer case of one or more pieces encasing said pocket-sized waterproof container with a top opening coincident with the top opening of said pocket-sized waterproof container.

9. A pocket-sized device for non-destructive transforming of tissue paper in real time, comprising:

a pocket-sized waterproof container capable of holding a volume of liquid, with a top opening through which to intermittently add and access liquid; and a flexible coarse mesh mold with holes that is engaged from a top side of said pocket-sized waterproof container instead of being an integral part of the pocket-sized waterproof container, leaving no gap between the flexible coarse mesh and the pocket-sized waterproof container;

a mass of tissue paper placed in the pocket-sized waterproof container and adjacent to the flexible coarse mesh mold;

wherein, the flexible coarse mesh mold is able to be repeatedly pressed downward with the mass of tissue paper, and deform and extend to dip into the liquid, and wet and mold the tissue paper through the holes of the flexible coarse mesh mold to form substantial densified textural nubs of the tissue paper, and return to a relaxed form and position when the tissue paper is withdrawn;

wherein, a circumference of the flexible coarse mesh mold includes a slot that matches and clicks with a flange placed on an inner side wall of the pocket-sized waterproof container, securing the flexible coarse mesh mold in place.

* * * * *